US007727122B2

(12) United States Patent
Kuo

(10) Patent No.: US 7,727,122 B2
(45) Date of Patent: Jun. 1, 2010

(54) FOLDABLE TREADMILL

(76) Inventor: Hai-Pin Kuo, 15, Lane 833, Wei Hsien Rd., Tainan City (TW)

( * ) Notice: Subject to any disclaimer, the term of this patent is extended or adjusted under 35 U.S.C. 154(b) by 569 days.

(21) Appl. No.: 11/702,998

(22) Filed: Feb. 6, 2007

(65) Prior Publication Data

US 2008/0188358 A1 Aug. 7, 2008

(51) Int. Cl.
*A63B 22/02* (2006.01)

(52) U.S. Cl. ..... 482/54; 482/51

(58) Field of Classification Search ..... 482/54, 482/1, 51, 57, 64, 66, 75, 114, 133, 139, 482/148; 472/14, 48, 90
See application file for complete search history.

(56) References Cited

U.S. PATENT DOCUMENTS 7,104,930 B2 * 9/2006 Lo et al. ..... 482/54
7,329,209 B2 * 2/2008 Lo ..... 482/54
2005/0009667 A1 * 1/2005 Chen ..... 482/54
2005/0192163 A1 * 9/2005 Pan et al. ..... 482/54
2006/0003869 A1 * 1/2006 Huang et al. ..... 482/54

* cited by examiner

*Primary Examiner*—Nicholas D Lucchesi
*Assistant Examiner*—Shila Abyaneh
(74) *Attorney, Agent, or Firm*—Alan Kamrath; Kamrath & Associates PA

(57) ABSTRACT

A foldable treadmill includes a base frame, a front frame pivotally mounted on the base frame, a rear frame pivotally mounted on the front frame, a movable frame pivotally mounted on the front frame and slidably mounted on the base frame, a driver mounted on the front frame and provided with a retractable inner tube, and a connecting bracket secured on the movable frame and pivotally mounted on the inner tube of the driver. Thus, the rear frame is folded when not in use to reduce the whole volume of the treadmill efficiently. In addition, the front end of the rear frame is lifted to change the inclined angle of the rear frame, so that the user can practice running or walking on a slope.

17 Claims, 9 Drawing Sheets

FOLDABLE TREADMILL

BACKGROUND OF THE INVENTION

1. Field of the Invention

The present invention relates to a treadmill and, more particularly, to a foldable treadmill.

2. Description of the Related Art

A conventional foldable treadmill comprises a base having an upright rack, and a frame pivotally mounted on the upright rack of the base by a pivot shaft. The frame is provided with two rotation shafts and a belt. A motor is mounted on the frame to rotate the rotation shafts so as to move the belt. Thus, the frame is pivoted about the pivot shaft to move toward the upright rack of the base until the frame is disposed at an upright state so as to fold the treadmill when not in use.

However, when the pivot shaft is located at a front position of the frame, the user has to exert a larger force to pivot the frame, thereby causing a burden to the user. In addition, the motor is mounted on the frame, so that the frame has a heavier weight and is easily upset when being folded, thereby causing danger to the user. On the other hand, when the pivot shaft is located at a rear position of the frame, the front end of the frame easily touches the ground during the folding process, so that the pivot shaft needs to have a greater height to prevent the front end of the frame from hitting the ground, thereby causing inconvenience to the user.

BRIEF SUMMARY OF THE INVENTION

In accordance with the present invention, there is provided a foldable treadmill, comprising a base frame, a front frame having a front end pivotally mounted on a first end of the base frame, a rear frame having a front end pivotally mounted on a rear end of the front frame, a movable frame having a first end pivotally mounted on a mediate portion of the front frame and a second end slidably mounted on a second end of the base frame, a telescopically retractable driver mounted on the front frame and provided with a retractable inner tube which can extend outwardly from the driver, and a connecting bracket having a first end secured on the movable frame to move and pivot the movable frame and a second end pivotally mounted on the inner tube of the driver.

The primary objective of the present invention is to provide a foldable treadmill, wherein the rear frame is folded exactly and completely when not in use to reduce the whole volume of the treadmill efficiently, thereby facilitating storage of the treadmill.

Another objective of the present invention is to provide a foldable treadmill, wherein the front frame is pivoted by the motor automatically, and the rear frame is pivoted manually during the folding process of the treadmill, so that the treadmill is folded in a two-stage semi-automatic manner.

A further objective of the present invention is to provide a foldable treadmill, wherein the front end of the rear frame is lifted by the motor automatically to change the inclined angle of the rear frame, so that the user can practice running or walking on a slope.

A further objective of the present invention is to provide a foldable treadmill, wherein the rear frame is folded during the folding process of the treadmill without folding the front frame, so that the treadmill has a lower center of gravity during the folding process, thereby assuring the safety of folding the treadmill.

A further objective of the present invention is to provide a foldable treadmill, wherein the front frame needs not to be inverted downward during the folding process of the treadmill so that the front frame is designed to have a smaller height, thereby facilitating the user operating the treadmill.

Further benefits and advantages of the present invention will become apparent after a careful reading of the detailed description with appropriate reference to the accompanying drawings.

BRIEF DESCRIPTION OF THE SEVERAL VIEWS OF THE DRAWING(S)

DETAILED DESCRIPTION OF THE INVENTION

Figure 1:
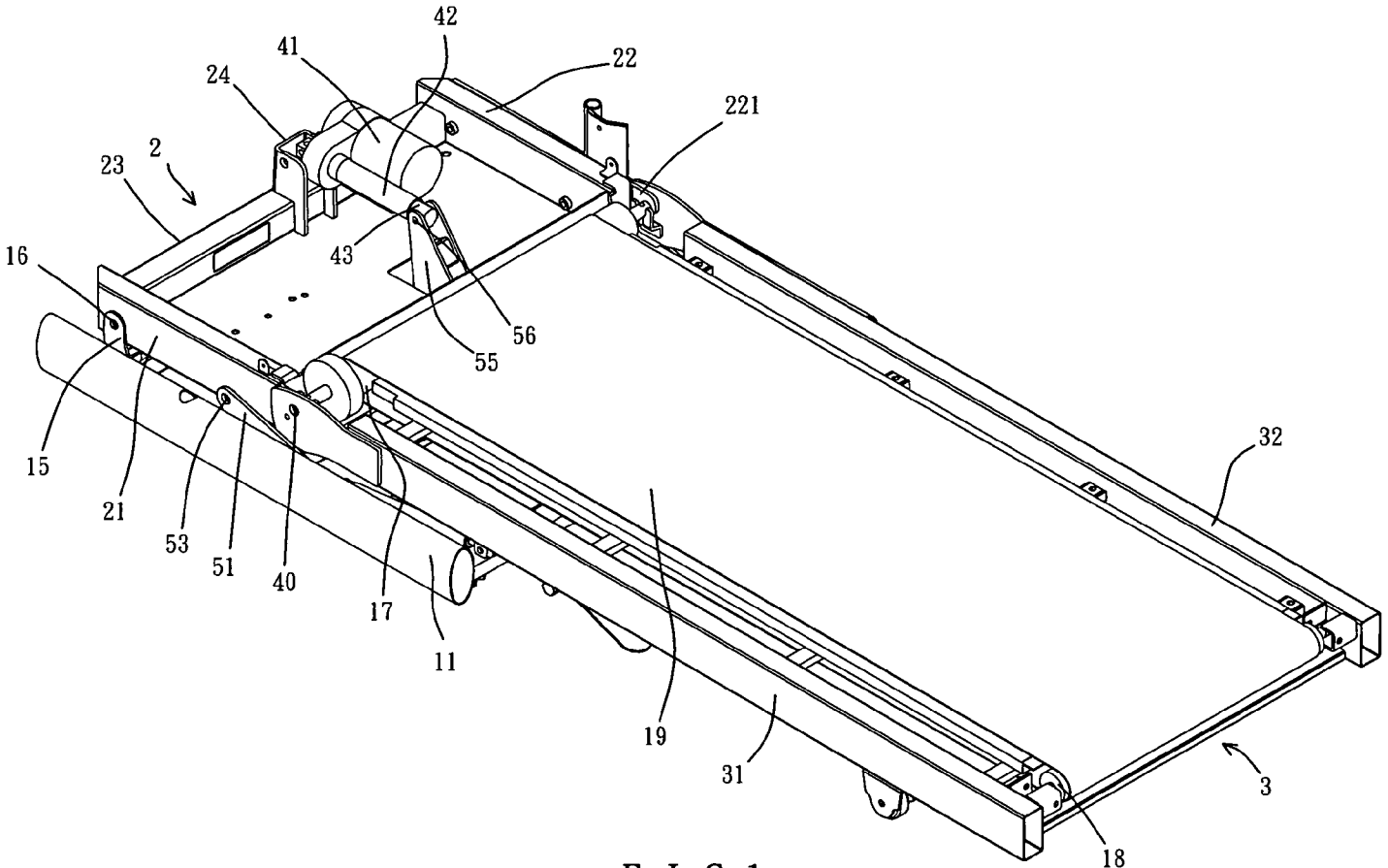
FIG. 1 is a perspective view of a foldable treadmill in accordance with the preferred embodiment of the present invention.

Referring to the drawings and initially to FIGS. 1-6, a foldable treadmill in accordance with the preferred embodiment of the present invention comprises a base frame 1, a front frame 2, a rear frame 3, and a movable frame 5.

The base frame 1 includes a left support pipe 11, a right support pipe 12, a front crossbeam 13 and a rear crossbeam 14. Each of the left support pipe 11 and the right support pipe 12 of the base frame 1 has an inner side formed with an elongated guide track 120. The rear crossbeam 14 of the base frame 1 is provided with a plurality of rollers 141 to facilitate movement of the base frame 1.

The front frame 2 is used to support a motor 41 and a telescopically retractable driver 42 and includes a front bracket 23, a left bracket 21 and a right bracket 22. The front bracket 23 of the front frame 2 is provided with a support board 24 to support the motor 41 and the driver 42. The driver 42 is provided with a retractable inner tube 43 which can extend outwardly from the driver 42. Each of the left bracket 21 and the right bracket 22 of the front frame 2 has a front end pivotally mounted on a front end of each of the left support pipe 11 and the right support pipe 12 of the base frame 1 by a pivot shaft 16 respectively. The front end of each of the left support pipe 11 and the right support pipe 12 of the base frame 1 is provided with a pivot seat 15 to pivot the respective pivot shaft 16.

The rear frame 3 includes a left rack 31, a right rack 32, a front rotation shaft 17, a rear rotation shaft 18 and a tread belt 19. The rear frame 3 has a front end pivotally mounted on the rear ends of the left bracket 21 and the right bracket 22 of the front frame 2 by two pivot axles 40 respectively. The rear end of each of the left bracket 21 and the right bracket 22 of the front frame 2 is provided with a pivot ear 211 and 221 to pivot the respective pivot axle 40.

The movable frame 5 has two opposite sides provided with a left side plate 51 and a right side plate 52 respectively. Each of the left side plate 51 and the right side plate 52 of the movable frame 5 has an upper end pivotally mounted on a mediate portion of each of the left bracket 21 and the right bracket 22 of the front frame 2 by a pivot spindle 53 respectively and has a lower end provided with a roller 50 which is slidable in the respective guide track 120 of each of the left support pipe 11 and the right support pipe 12 of the base frame 1. The roller 50 is rotatably mounted on the lower end of each of the left side plate 51 and the right side plate 52 of the movable frame 5 by a pintle 57.

A connecting bracket 55 has a first end secured on a mediate portion of the movable frame 5 to move and pivot the movable frame 5 and a second end pivotally mounted on the inner tube 43 of the driver 42 by a pivot pin 56.

Figure 2:
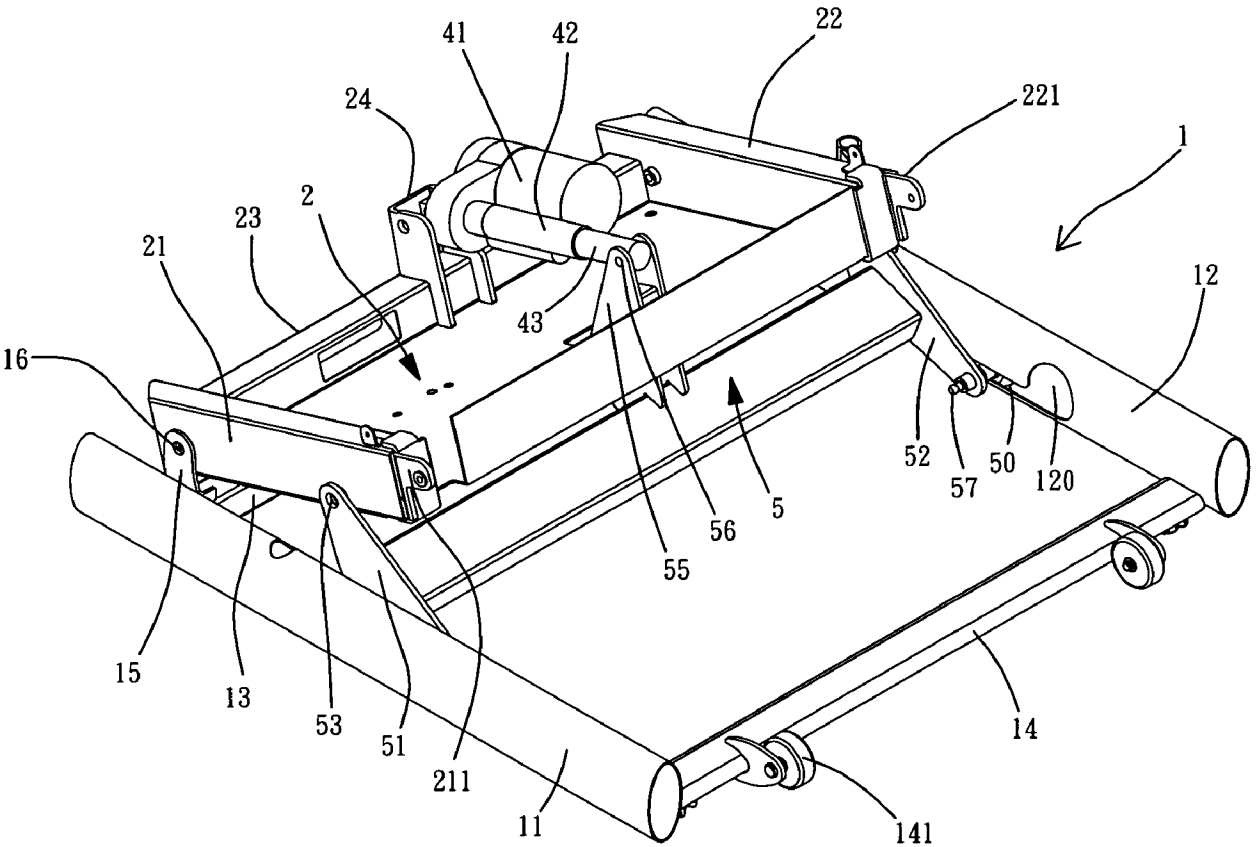
FIG. 2 is a partially perspective operational view of the foldable treadmill as shown in FIG. 1.
Figure 5:
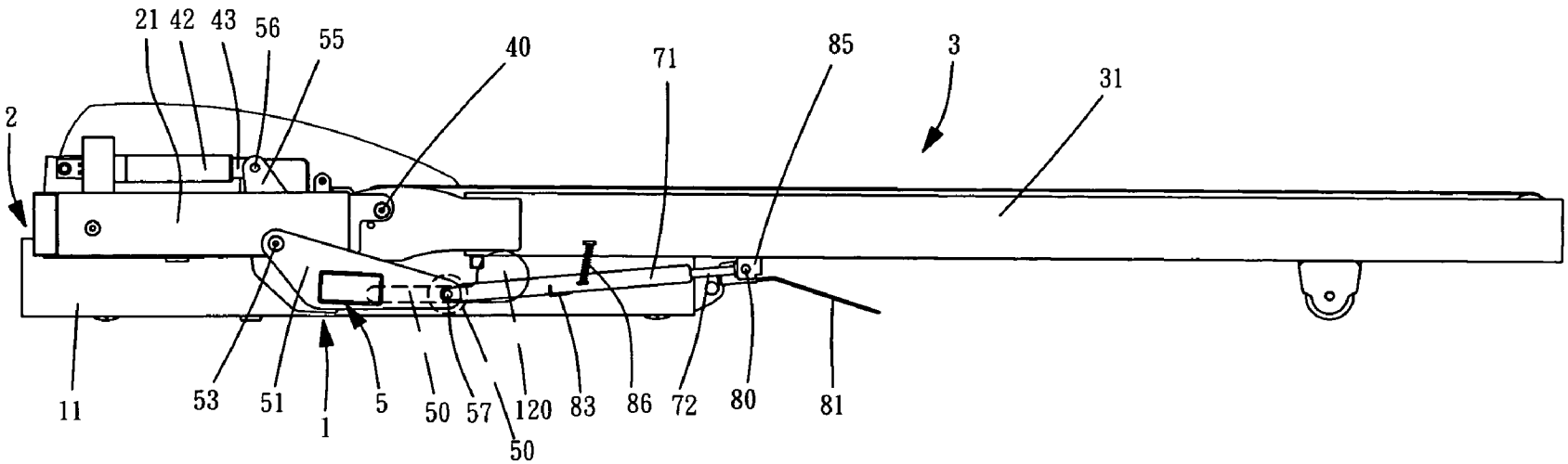
FIG. 5 is a side view of the foldable treadmill as shown in FIG. 1.
Figure 6:
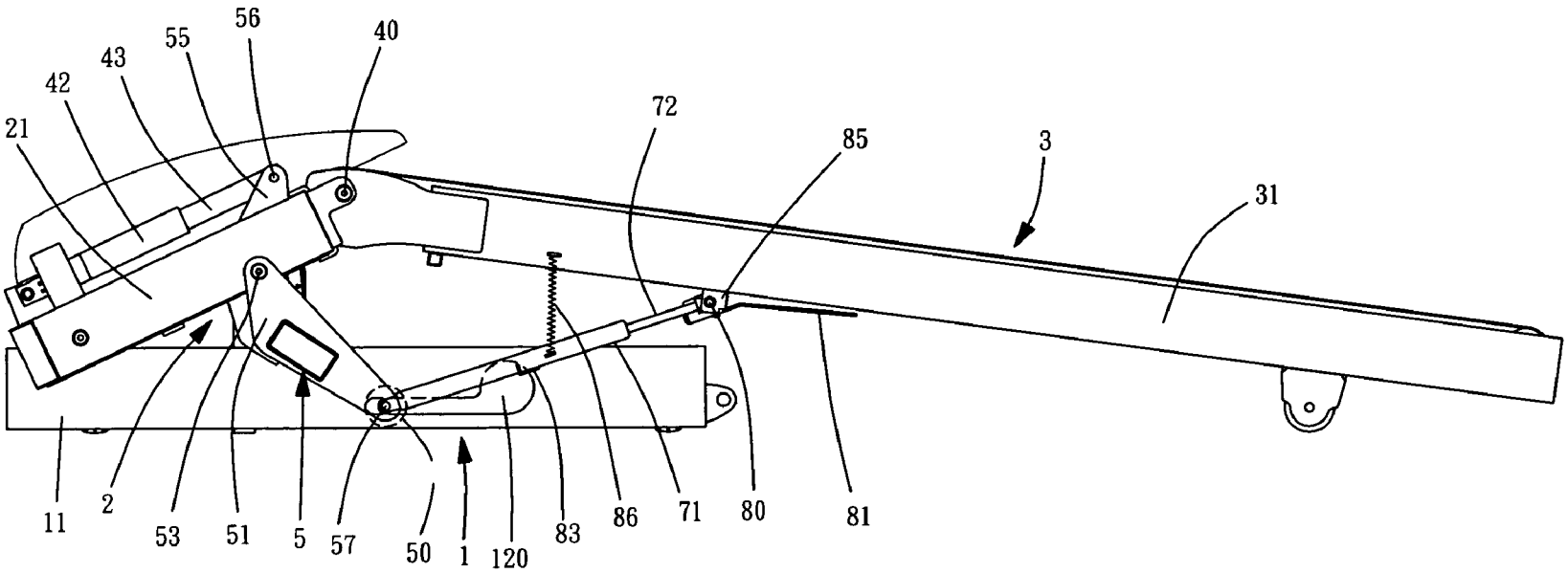
FIG. 6 is a schematic operational view of the foldable treadmill as shown in FIG. 5.

As shown in FIGS. 2, 5 and 6, when the inner tube 43 of the driver 42 is extended outwardly from the driver 42 by means of action of the motor 41, the inner tube 43 of the driver 42 pushes the connecting bracket 55 backward to rotate the connecting bracket 55, so that the movable frame 5 is pivoted forward and upward about the pivot spindles 53 to drive the roller 50 to slide forward in the respective guide track 120 of each of the left support pipe 11 and the right support pipe 12 of the base frame 1 to lift the rear end of the front frame 2 and to lift the front end of the rear frame 3 to change the inclined angle of the rear frame 3 as shown in FIG. 6. Thus, the user can practice running on a slope. At this time, the pivot axles 40 are lifted.

On the contrary, when the inner tube 43 of the driver 42 is retracted into the driver 42 by means of action of the motor 41, the connecting bracket 55 is pulled forward by the inner tube 43 of the driver 42, so that the movable frame 5 is pivoted backward and downward about the pivot spindles 53 to drive the roller 50 to slide backward in the respective guide track 120 of each of the left support pipe 11 and the right support pipe 12 of the base frame 1 to lower the rear end of the front frame 2 and to lower the front end of the rear frame 3. Thus, the front frame 2 and the rear frame 3 are disposed at a horizontal state as shown in FIG. 5. At this time, the pivot axles 40 are lowered.

Referring to FIGS. 1-9, the foldable treadmill further comprises a telescopically retractable positioning mechanism 7 pivotally mounted between the movable frame 5 and the rear frame 3 and movable by a pivot action of the rear frame 3, and a locking mechanism 8 mounted on the rear frame 3 and releasably locked onto the positioning mechanism 7 to releasably lock the positioning mechanism 7.

The positioning mechanism 7 is actuated by a pneumatic or hydraulic action and includes an outer tube 71 pivotally mounted on the left side plate 51 of the movable frame 5, and an inner tube 72 pivotally mounted on the left rack 31 of the rear frame 3 and retractably mounted in the outer tube 71.

The locking mechanism 8 includes a pivot board 82 pivotally mounted on the left rack 31 of the rear frame 3 by a pivot rod 80 and having a first end provided with a movable plate 83 movable on the outer tube 71 of the positioning mechanism 7 during a pivot movement of the rear frame 3 to a locked position where the movable plate 83 is locked on the inner tube 72 of the positioning mechanism 7 and rested on a distal end of the outer tube 71 of the positioning mechanism 7 so as to lock the positioning mechanism 7, and an elastic member 86 biased between the movable plate 83 of the pivot board 82 and the left rack 31 of the rear frame 3 to pull the movable plate 83 of the pivot board 82 toward the rear frame 3. The inner tube 72 of the positioning mechanism 7 has a distal end pivotally mounted on the left rack 31 of the rear frame 3 by the pivot rod 80. The movable plate 83 of the pivot board 82 is formed with a locking groove 84 locked on the inner tube 72 and the distal end of the outer tube 71 of the positioning mechanism 7 during the pivot movement of the rear frame 3. The locking groove 84 of the movable plate 83 has an opening directed toward the rear frame 3. The pivot board 82 of the locking mechanism 8 has a second end provided with a drive plate 81 that is movable toward the rear frame 3 to pivot the pivot board 82 to move the movable plate 83 outwardly relative to the rear frame 3 to detach the movable plate 83 from the distal end of the outer tube 71 so as to unlock the positioning mechanism 7. The pivot board 82 of the locking mechanism 8 has a mediate portion provided with a pivot base 85 located between the movable plate 83 and the drive plate 81 and pivotally mounted on the left rack 31 of the rear frame 3 by the pivot rod 80.

Figure 3:
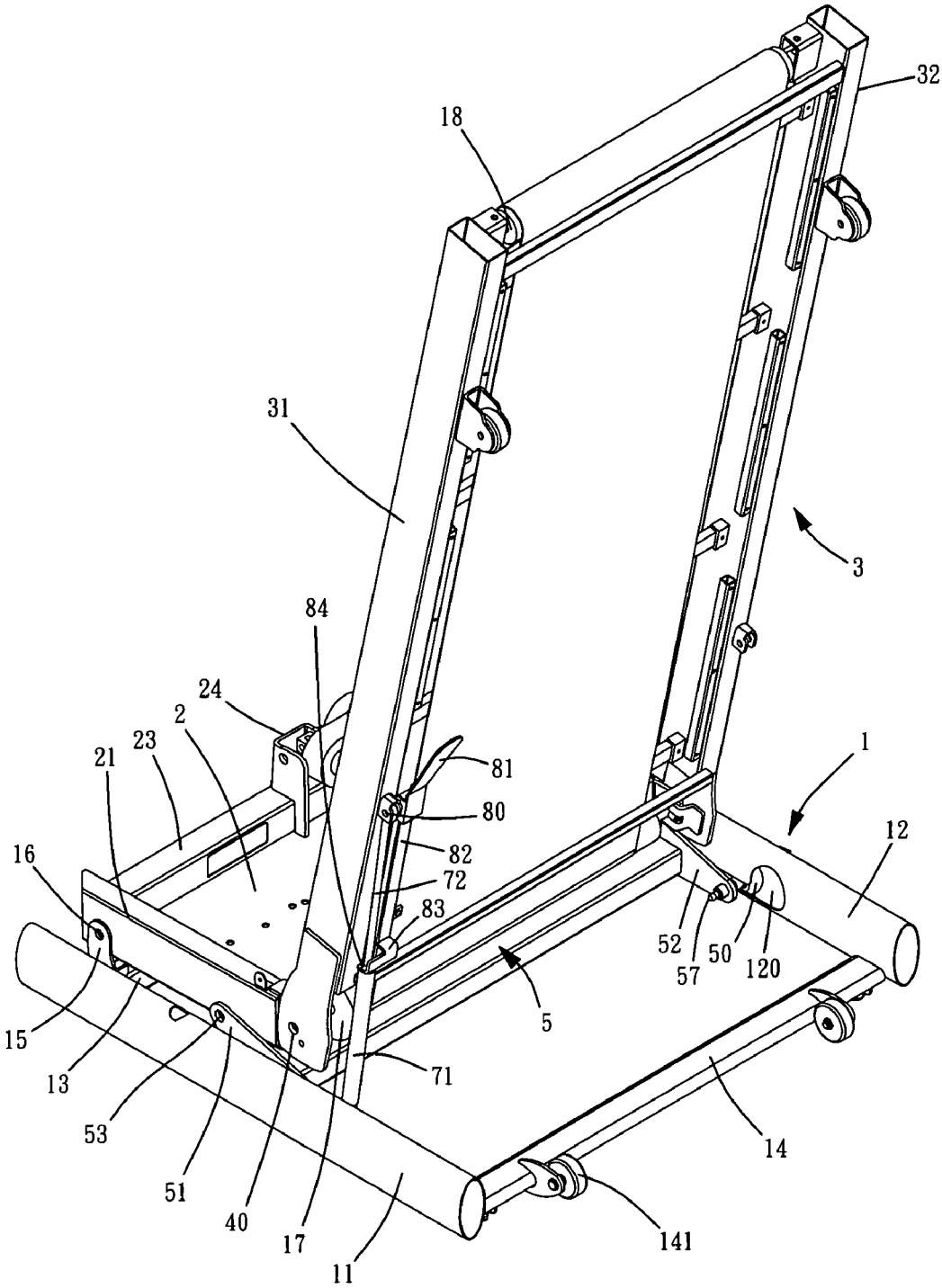
FIG. 3 is a perspective operational view of the foldable treadmill as shown in FIG. 1.
Figure 4:
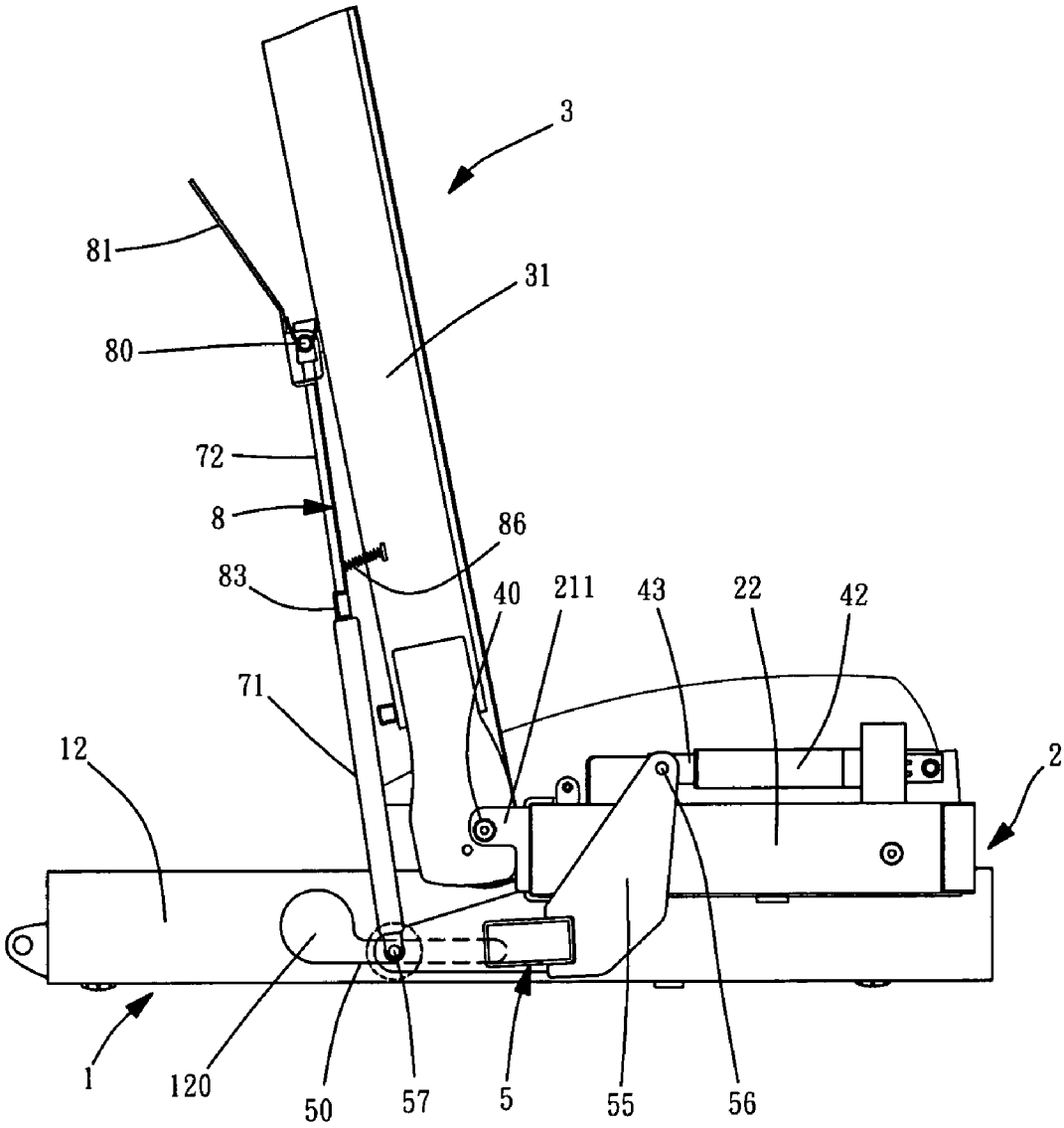
FIG. 4 is a partially side view of the foldable treadmill as shown in FIG. 3.

As shown in FIGS. 1, 3 and 4, when the rear end of the rear frame 3 is lifted to drive the rear frame 3 to pivot from the position as shown in FIG. 1 to the position as shown in FIG. 3, the inner tube 72 of the positioning mechanism 7 is driven by the rear frame 3 to extend outwardly relative to the outer tube 71 of the positioning mechanism 7, and the pivot board 82 of the locking mechanism 8 is driven by the rear frame 3 to move outwardly relative to the outer tube 71 of the positioning mechanism 7, so that the movable plate 83 of the pivot board 82 is movable upward on the outer tube 71 of the positioning mechanism 7 during the pivot movement of the rear frame 3 to the locked position where the locking groove 84 of the movable plate 83 is locked on the inner tube 72 and the distal end of the outer tube 71 of the positioning mechanism 7 by an elastic force of the elastic member 86 so as to lock the positioning mechanism 7. Thus, when the rear frame 3 is disposed at an upright state, the positioning mechanism 7 is locked by the locking mechanism 8 to support when the rear frame 3 solidly and stably, so that the rear frame 3 is folded exactly and completely as shown in FIG. 3.

On the contrary, the drive plate 81 of the pivot board 82 is pressed toward the rear frame 3 to pivot the pivot board 82 to move the movable plate 83 outwardly relative to the rear frame 3 to detach the locking groove 84 of the movable plate 83 from the distal end of the outer tube 71 so as to unlock the positioning mechanism 7, so that the movable plate 83 of the pivot board 82 is movable downward on the outer tube 71 of the positioning mechanism 7 to lower the rear frame 3 until the rear frame 3 is disposed at a horizontal state as shown in FIG. 1.

Figure 7:
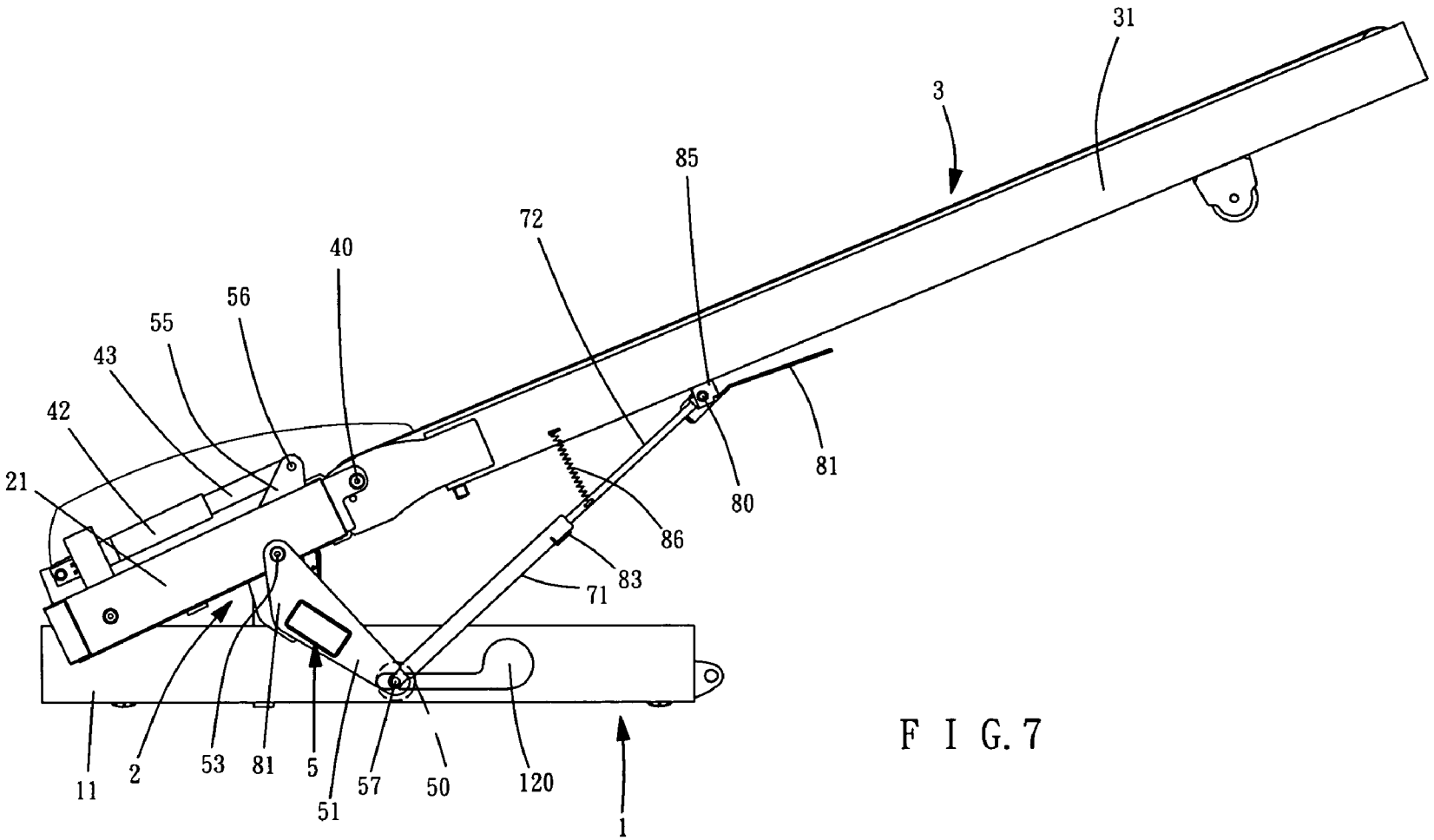
FIG. 7 is a schematic operational view of the foldable treadmill as shown in FIG. 6.
Figure 8:
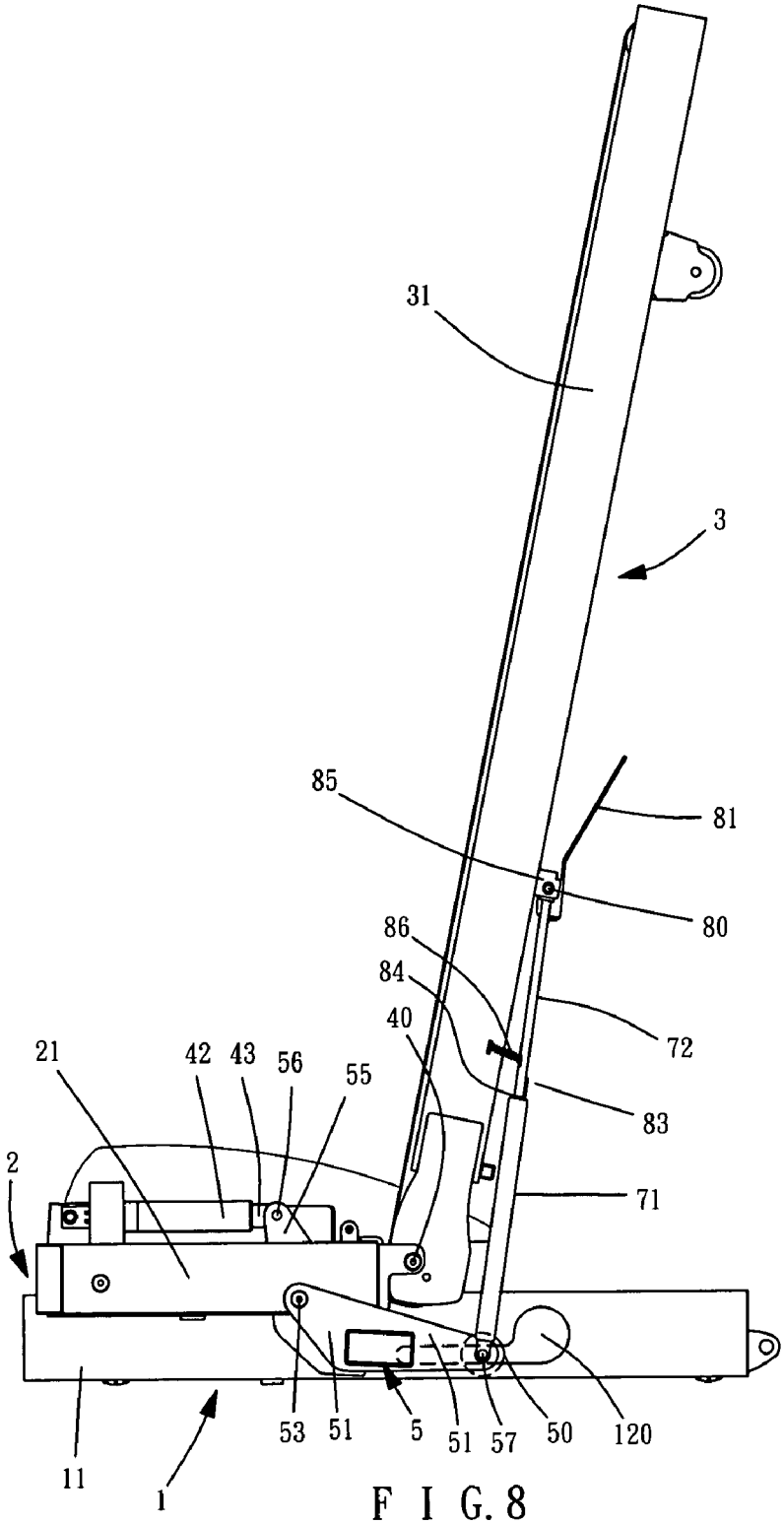
FIG. 8 is a schematic operational view of the foldable treadmill as shown in FIG. 7.
Figure 9:
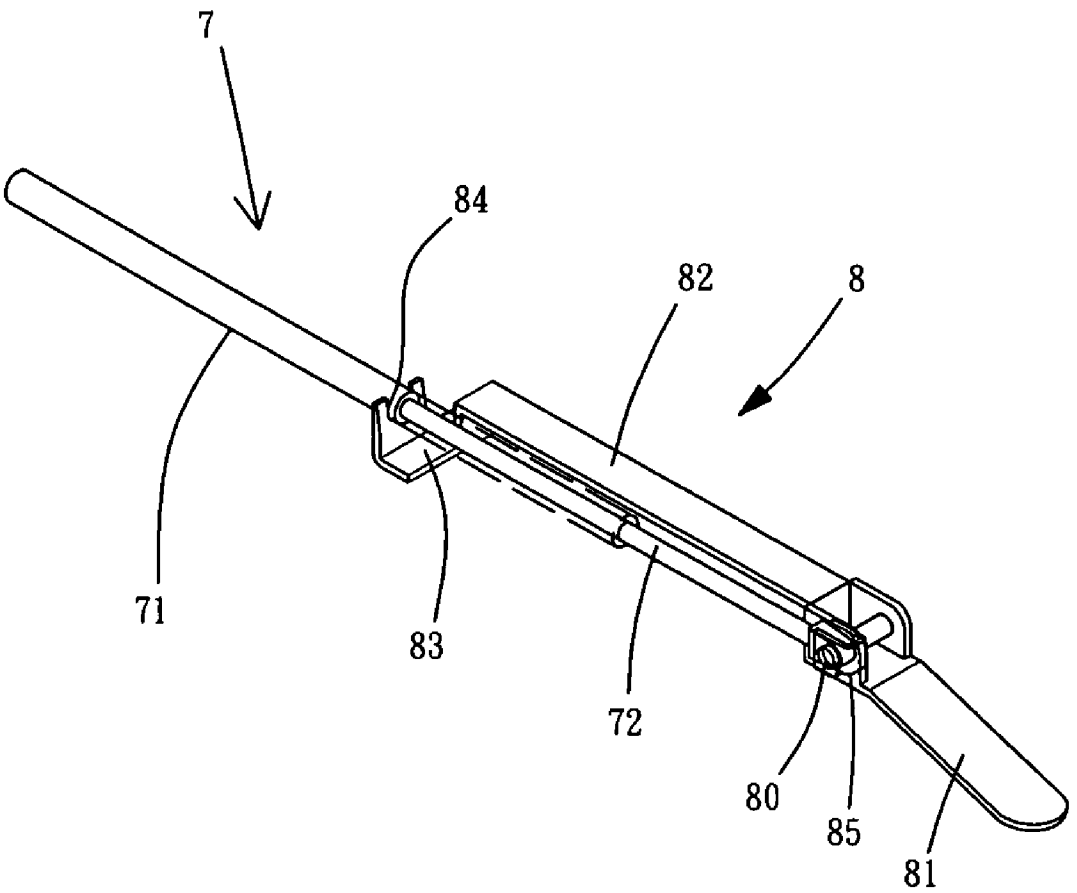
FIG. 9 is a perspective operational view of a positioning mechanism and a locking mechanism of the foldable treadmill as shown in FIG. 1.

In operation, referring to FIGS. 5-8 with reference to FIGS. 1-4, the rear frame 3 is initially disposed at a horizontal state as shown in FIGS. 1 and 5. When the inner tube 43 of the driver 42 is extended outwardly from the driver 42 by means of action of the motor 41, the inner tube 43 of the driver 42 pushes the connecting bracket 55 backward to rotate the connecting bracket 55, so that the movable frame 5 is pivoted forward and upward about the pivot spindles 53 to drive the roller 50 to slide forward in the respective guide track 120 of each of the left support pipe 11 and the right support pipe 12 of the base frame 1 to lift the rear end of the front frame 2 and to lift the front end of the rear frame 3 as shown in FIGS. 2 and 6. Then, the rear end of the rear frame 3 is lifted to drive the rear frame 3 to pivot from the position as shown in FIG. 6 to the position as shown in FIG. 7. At this time, the motor 41 is driven (by a program design and a related detection mechanism) to operate in the reverse direction to retract the inner tube 43 into the driver 42 to pull the connecting bracket 55 forward, so that the movable frame 5 is pivoted backward and downward about the pivot spindles 53 to drive the roller 50 to slide backward in the respective guide track 120 of each of the left support pipe 11 and the right support pipe 12 of the base frame 1 to lower the rear end of the front frame 2 and to lower the front end of the rear frame 3 until the front frame 2 is disposed at a horizontal state, thereby facilitating the upward movement the rear end of the rear frame 3. Then, the rear end of the rear frame 3 is lifted successively until the rear frame 3 is disposed at an upright state as shown in FIGS. 1 and 8. At the same time, the inner tube 72 of the positioning mechanism 7 is driven by the rear frame 3 to extend outwardly relative to the outer tube 71 of the positioning mechanism 7, and the pivot board 82 of the locking mechanism 8 is driven by the rear frame 3 to move outwardly relative to the outer tube 71 of the positioning mechanism 7, so that the movable plate 83 of the pivot board 82 is movable upward on the outer tube 71 of the positioning mechanism 7 from the position as shown in FIG. 7 to the locked position as shown in FIG. 8 where the locking groove 84 of the movable plate 83 is locked on the inner tube 72 and the distal end of the outer tube 71 of the positioning mechanism 7 by the elastic force of the elastic member 86 so as to lock the positioning mechanism 7. Thus, when the rear frame 3 is disposed at an upright state, the positioning mechanism 7 is locked by the locking mechanism 8 to support when the rear frame 3 solidly and stably, so that the rear frame 3 is folded exactly and completely as shown in FIG. 3.

Accordingly, the rear frame 3 is folded exactly and completely when not in use to reduce the whole volume of the treadmill efficiently, thereby facilitating storage of the treadmill. In addition, the front frame 2 is pivoted by the motor 41 automatically, and the rear frame 3 is pivoted manually during the folding process of the treadmill, so that the treadmill is folded in a two-stage semi-automatic manner. Further, the front end of the rear frame 3 is lifted by the motor 41 automatically to change the inclined angle of the rear frame 3, so that the user can practice running or walking on a slope. Further, the rear frame 3 is folded during the folding process of the treadmill without folding the front frame 2, so that the treadmill has a lower center of gravity during the folding process, thereby assuring the safety of folding the treadmill. Further, the front frame 2 needs not to be inverted downward during the folding process of the treadmill so that the front frame 2 is designed to have a smaller height, thereby facilitating the user operating the treadmill.

Although the invention has been explained in relation to its preferred embodiment(s) as mentioned above, it is to be understood that many other possible modifications and variations can be made without departing from the scope of the present invention. It is, therefore, contemplated that the appended claim or claims will cover such modifications and variations that fall within the true scope of the invention.

The invention claimed is:

1. A foldable treadmill, comprising:

a base frame;

a front frame having a front end pivotally mounted on a first end of the base frame;

a rear frame having a front end pivotally mounted on a rear end of the front frame;

a movable frame having a first end pivotally mounted on a mediate portion of the front frame between the front end and the rear end of the front frame and a second end slidably mounted on a second end of the base frame;

a telescopically retractable driver mounted on the front frame and provided with a retractable inner tube which can extend outwardly from the driver;

a connecting bracket having a first end secured on the movable frame to move and pivot the movable frame and a second end pivotally mounted on the inner tube of the driver;

a motor mounted on the front frame to drive and move the inner tube of the driver;

a telescopically retractable positioning mechanism pivotally mounted between the movable frame and the rear frame and movable by a pivot action of the rear frame;

a locking mechanism mounted on the rear frame and releasably locked onto the positioning mechanism to releasably lock the positioning mechanism; wherein the movable frame is pivotable relative to the base frame to drive the front end of the front frame to pivot relative to the base frame so as to move the rear end of the front frame relative to the base frame and to move the front end of the rear frame relative to the base frame;

the movable frame is movable forward and backward relative to the base frame.

2. The foldable treadmill as claimed in claim 1, wherein:

the telescopically retractable positioning mechanism includes an outer tube pivotally mounted on the movable frame, and an inner tube pivotally mounted on the rear frame and retractably mounted in the outer tube;

the locking mechanism includes an elongate pivot board pivotally mounted on the rear frame and having a first end provided with a substantially L-shaped movable plate movable on the outer tube of the telescopically retractable positioning mechanism during a pivot movement of the rear frame to a locked position where the movable plate is locked on the inner tube of the positioning mechanism and rested on a distal end of the outer tube of the telescopically retractable positioning mechanism so as to lock the positioning mechanism.

3. The foldable treadmill as claimed in claim 2, wherein the pivot board of the locking mechanism has a second end provided with an oblique drive plate that is inclined outwardly relative to the rear frame and is movable toward the rear frame to pivot the pivot board relative to the rear frame and the telescopically retractable positioning mechanism to move the movable plate outwardly relative to the rear frame to detach the movable plate from the distal end of the outer tube so as to unlock the telescopically retractable positioning mechanism.

4. The foldable treadmill as claimed in claim 3, wherein the pivot board of the locking mechanism is pivotally mounted on the rear frame by a pivot rod.

5. The foldable treadmill as claimed in claim 4, wherein the inner tube of the telescopically retractable positioning mechanism has a distal end pivotally mounted on the rear frame by the pivot rod.

6. The foldable treadmill as claimed in claim 4, wherein the pivot board of the locking mechanism has a mediate portion provided with a pivot base located between the movable plate and the drive plate and pivotally mounted on the rear frame by the pivot rod.

7. The foldable treadmill as claimed in claim 2, wherein the movable plate of the pivot board is formed with a substantially semi-circular locking groove locked on the inner tube and rested on the distal end of the outer tube of the telescopically retractable positioning mechanism during the pivot movement of the rear frame.

8. The foldable treadmill as claimed in claim 7, wherein the locking mechanism further includes an elastic member biased between the movable plate of the pivot board and the rear frame to pull the movable plate of the pivot board toward the rear frame and the telescopically retractable positioning mechanism.

9. The foldable treadmill as claimed in claim 8, wherein when a rear end of the rear frame is lifted to drive and pivot the rear frame, the inner tube of the telescopically retractable positioning mechanism is driven by the rear frame to extend outwardly relative to the outer tube of the telescopically retractable positioning mechanism, and the pivot board of the locking mechanism is driven by the rear frame to move outwardly relative to the outer tube of the telescopically retractable positioning mechanism, so that the movable plate of the pivot board is movable upward on the outer tube of the telescopically retractable positioning mechanism during the pivot movement of the rear frame to the locked position where the locking groove of the movable plate is locked on the inner tube and the distal end of the outer tube of the telescopically retractable positioning mechanism by an elastic force of the elastic member so as to lock the telescopically retractable positioning mechanism.

10. The foldable treadmill as claimed in claim 1, wherein:

the base frame includes a left support pipe, a right support pipe, a front crossbeam and a rear crossbeam;

the front crossbeam is located between the left support pipe and the right support pipe;

the rear crossbeam is located between the left support pipe and the right support pipe;

the front frame includes a front bracket, a left bracket and a right bracket;

the front bracket is located between the left bracket and the right bracket;

the rear frame includes a left rack, a right rack, a front rotation shaft, a rear rotation shaft and a tread belt;

the movable frame has two opposite sides provided with a left side plate and a right side plate respectively.

11. The foldable treadmill as claimed in claim 10, wherein each of the left support pipe and the right support pipe of the base frame has an liner side formed with an elongated guide track, and each of the left side plate and the right side plate of the movable frame has a lower end provided with a roller which is received in each of the left support pipe and the right support pipe of the base frame and is slidable in the respective guide track of each of the left support pipe and the right support pipe of the base frame to move the movable frame relative to the base frame.

12. The foldable treadmill as claimed in claim 11, wherein the roller is rotatably mounted on the lower end of each of the left side plate and the right side plate of the movable frame by a pintle.

13. The foldable treadmill as claimed in claim 10, wherein:

each of the left bracket and the right bracket of the front frame has a front end pivotally mounted on a front end of each of the left support pipe and the right support pipe of the base frame by a pivot shaft respectively;

the front end of the rear frame is pivotally mounted on rear ends of the left bracket and the right bracket of the front frame by two pivot axles respectively;

each of the left side plate and the right side plate of the movable frame has an upper end pivotally mounted on a mediate portion of each of the left bracket and the right bracket of the front frame by a pivot spindle respectively between the front end and the rear end of each of the left bracket and the right bracket of the front frame.

14. The foldable treadmill as claimed in claim 13, wherein front bracket of the front frame is provided with a support board to support the motor and the driver;

the front end of each of the left support pipe and the right support pipe of the base frame is provided with a protruding pivot seat rested on each of the left bracket and the right bracket of the front frame to pivot the respective pivot shaft;

the rear end of each of the left bracket and the right bracket of the front frame is provided with a protruding pivot ear to pivot the respective pivot axle.

15. The foldable treadmill as claimed in claim 1, wherein the telescopically retractable positioning mechanism is actuated by a pneumatic or hydraulic action.

16. The foldable treadmill as claimed in claim 1, wherein the inner tube of the telescopically retractable driver is pushed toward the base frame and pushes the connecting bracket backward to rotate the connecting bracket, and the movable frame is pivoted forward and upward by the connecting bracket to lift the rear end of the front frame and to lift the front end of the rear frame to change an inclined angle of the rear frame.

17. The foldable treadmill as claimed in claim 1, wherein the movable frame is pivotable and movable between the front frame and the base frame;

the first end of the connecting bracket is secured on a mediate portion of the movable frame.

* * * * *